US007134376B1

(12) United States Patent
Chen

(10) Patent No.: US 7,134,376 B1
(45) Date of Patent: Nov. 14, 2006

(54) STRAND FEEDING DEVICE FOR A COAXIAL CABLE BRAIDING APPARATUS

(76) Inventor: Ming-Cheng Chen, No. 55, Lane 278, Haiwei Rd., Longjing Township, Taichung County 434 (TW)

( * ) Notice: Subject to any disclaimer, the term of this patent is extended or adjusted under 35 U.S.C. 154(b) by 0 days.

(21) Appl. No.: 11/390,168

(22) Filed: Mar. 28, 2006

(51) Int. Cl.
*D04C 3/18* (2006.01)

(52) U.S. Cl. ..... 87/55

(58) Field of Classification Search ..... 87/33, 87/39–51, 54–57
See application file for complete search history.

(56) References Cited

U.S. PATENT DOCUMENTS 5,370,031 A * 12/1994 Koyfman et al. ..... 87/55
5,383,387 A * 1/1995 Chesterfield et al. ..... 87/56
5,520,084 A * 5/1996 Chesterfield et al. ..... 87/56
5,732,611 A * 3/1998 Voyer et al. ..... 87/56
6,450,078 B1 * 9/2002 Frank et al. ..... 87/55
6,810,785 B1 * 11/2004 Chen ..... 87/56
2006/0042457 A1 * 3/2006 Ratera Francitorra ..... 87/33

* cited by examiner

*Primary Examiner*—Shaun R. Hurley
(74) *Attorney, Agent, or Firm*—Rosenberg, Klein & Lee

(57) ABSTRACT

A strand feeding device includes a seat body, a bobbin-mounting post extending uprightly from said seat body, a bobbin sleeved rotatably around the post, a pair of strand-guiding posts extending upwardly from the seat body and a strand-guiding member installed at the distal end of said strand-guiding posts. Said strand-guiding member includes an aperture, formed by a pair of first arc segments having a major axis with respect to which the aperture is symmetrical, and a pair of second arc segments having a minor axis with respect to which the aperture is symmetrical. This configuration of aperture enhances the braiding fluency and produces a coaxial cable with high quality of insulation.

3 Claims, 6 Drawing Sheets

STRAND FEEDING DEVICE FOR A COAXIAL CABLE BRAIDING APPARATUS

BACKGROUND OF THE INVENTION

1. Field of the Invention

The present invention relates to a strand feeding device, in particularly to prevent the strands from breakage and produce a cable with high transmitted quality.

2. Description of the Related Art

Refer to FIG. 1, a general cable 1 is able to lower the interference of electromagnetism and signal by wrapping the wire 11 with the braided strands 29 and further covering by the plastic materials 12.

Refer to FIG. 2, a conventional strand feeding device 2 includes a seat body 21, a bobbin-mounting post 22 extending uprightly from said seat body 21, a bobbin 23 sleeved rotatably around said bobbin-mounting post 22, a swinging arm 25 pivoted to the seat body 21 and providing with a lower strand-guiding reel 28, a pair of guiding posts 24 extending upwardly from the seat body 21 and having an upper strand-guiding reel 28 mounted adjustably on said guiding posts 24, and a strand-guiding member 26 installed at the distal end of said guiding posts 24 and having a circular aperture 27 defining thereon.

In use, the conventional strand feeding device has several defects:

1. The strands tend to be overlapped when a circular aperture does not provide sufficient space to let each of strands vertically appose on which results of the strands easily breakage. The operators have to combine the broken strands which delay the working process.
2. Further, because of overlapping of said strands, there will be some unnecessary interstice arose between strand and strand after braiding which lower the insolating quality of the cable.

SUMMARY OF THE INVENTION

Therefore, the object of present invention is to provide a strand feeding device for a coaxial cable braiding apparatus, which includes a strand-guiding member with a aperture, that is capable of overcoming the aforesaid drawback of the prior art.

The present invention relates to strand feeding device that comprises a seat body, a bobbin-mounting post extending uprightly from said seat body, a bobbin sleeved rotatably around said bobbin-mounting post, a swinging arm pivoted to the seat body and providing with a lower strand-guiding reel, a pair of guiding posts extending upwardly from the seat body and having an upper strand-guiding reel mounted adjustably on said guiding posts, and a strand-guiding member mounted at the distal end of the guiding posts. Said strand-guiding member has an aperture defined thereon. Said aperture, formed by a pair of first arc segments has a major axis with respect to which the aperture is symmetrical and a pair of second arc segments having a minor axis with respect to which the aperture is symmetrical. This configuration of the aperture permits the strands to pass over smoothly and prevents the braided strands from overlapping which produce a coaxial cable with high quality of insulation and regular appearance.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
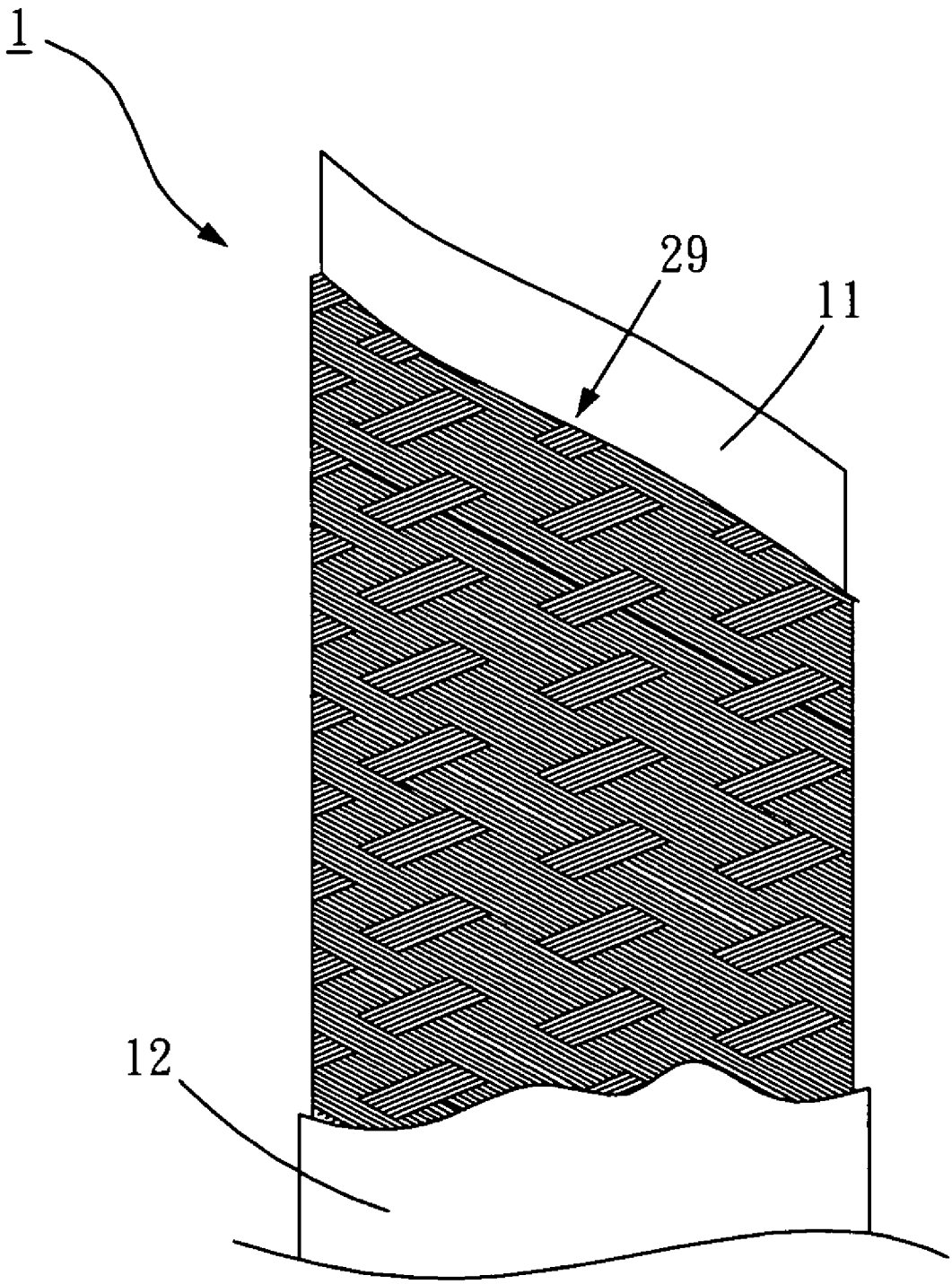
Fig. 1(Prior Art)
FIG. 1 is a partial perspective view to show the conventional cable.
Figure 2:
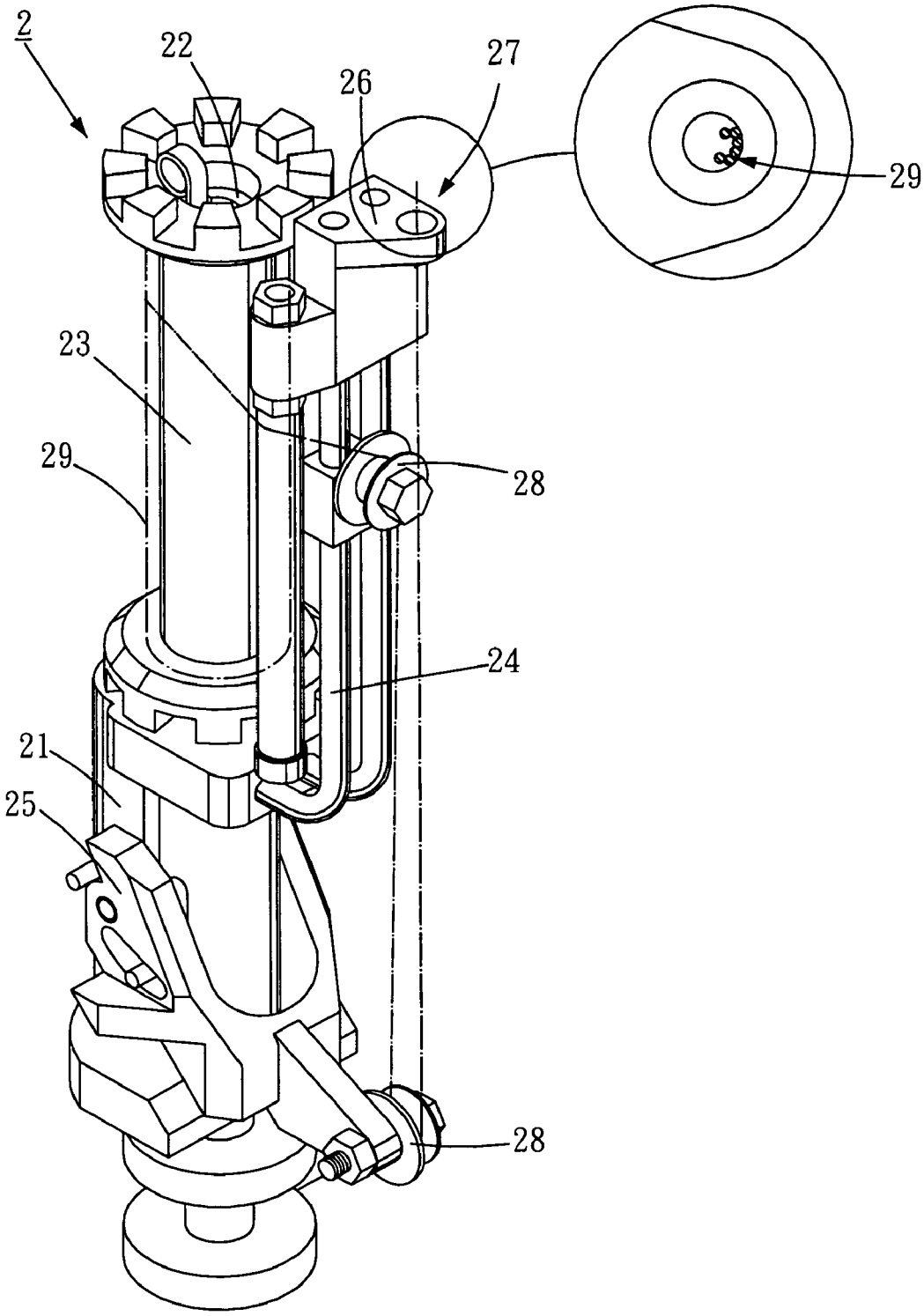
Fig. 2(Prior Art)
FIG. 2 is a perspective view to show the conventional strand feeding device.
Figure 3:
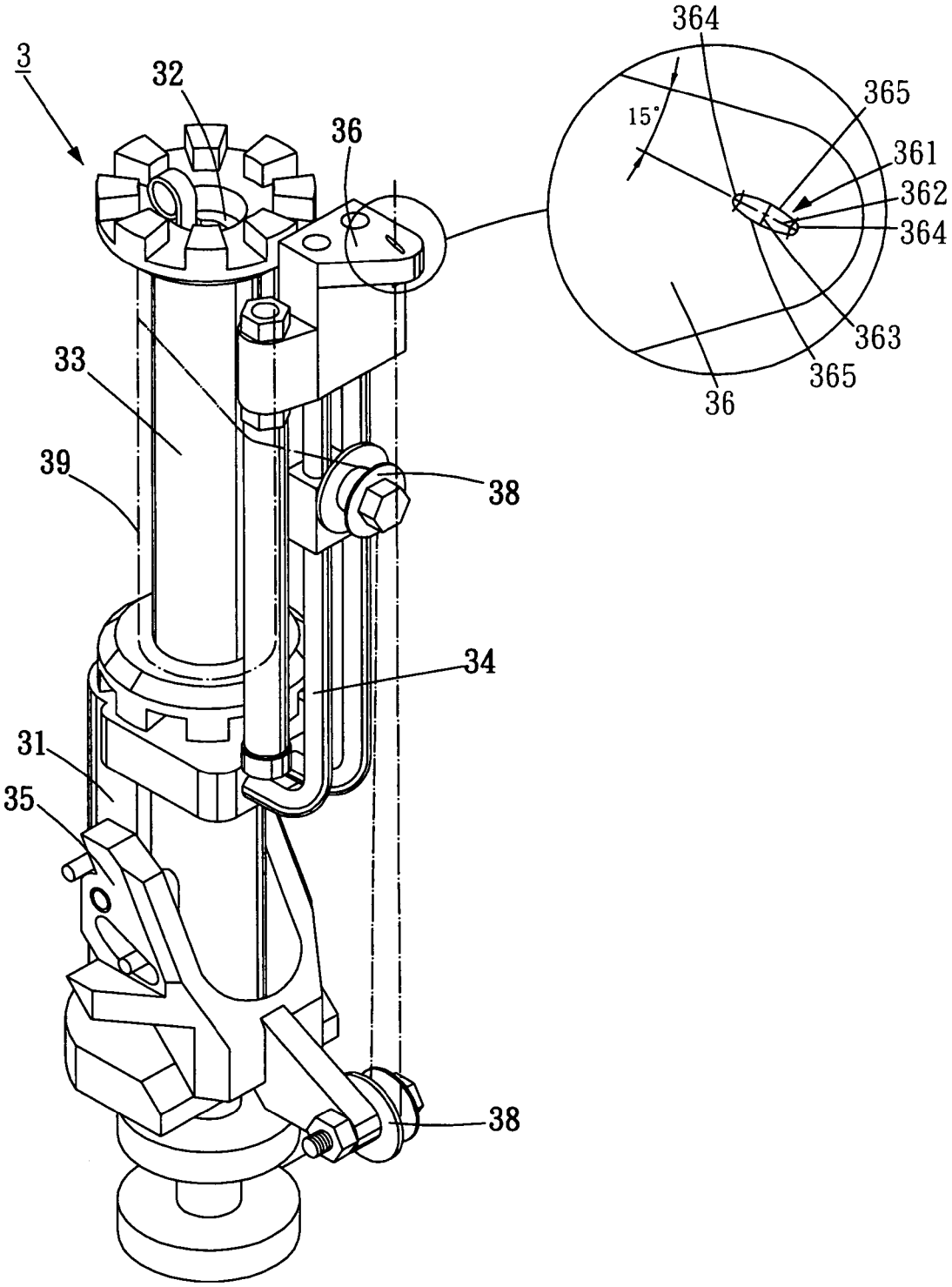
FIG. 3 is a perspective view to show the first preferred embodiment of the present invention.
Figure 4:
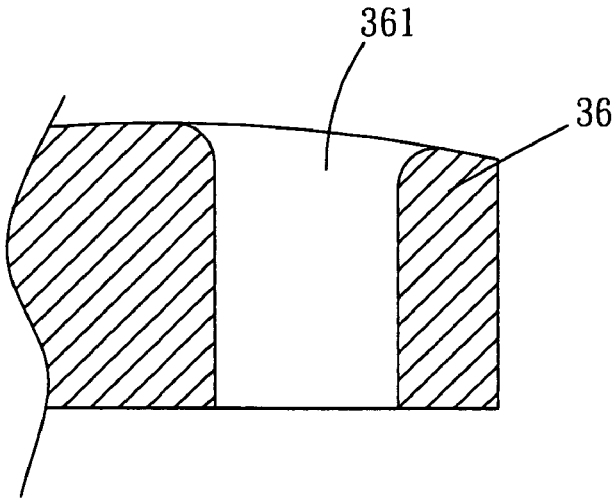
FIG. 4 is a cross sectional view of the strand-guiding member of the first preferred embodiment of the present invention.

Referring to FIG. 3, the strand feeding device 3 of the first preferred embodiment of present invention comprises a seat body 31, a bobbin-mounting post 32 extending uprightly from said seat body 31 in a longitudinal direction, a bobbin 33 sleeved rotatably around said bobbin-mounting post 32, a swinging arm pivoted 35 to the seat body 31 and provides with a lower strand-guiding reel 38, a pair of strands-guiding posts 34 extending upwardly from the seat body 31. Said strands-guiding posts 34 has an upper strand-guiding reel 38 mounted adjustably thereon and a strand-guiding member 36 installed at the distal end thereof. Said strand-guiding member includes slightly curved upper surface and a aperture 361 defined thereon for guiding strands from low strand-guiding reel 38 to the wire; As illustrated in FIG. 3, said aperture 361 having a pair of first arc segments 365 and a pair of second arc segments 364 in which one end of said first arc segment 365 is set to one end of said second arc segment 364 and the other end of said first arc segment 365 is set to the other end of said second arc segment 364. Said second arc segment 364 has a greater curvature than said first arc segment 365. Said aperture 361 formed by the first arc segments 365 having a major axis 362 with respect to which the aperture 361 is symmetrical, and the second arc segments 364 having a minor axis 363 with respect to which the aperture 361 is symmetrical. Said major axis 362 horizontally encloses a angle of 15° to the sidewall of the strand-guiding member 36. Besides, refer to FIG. 4, said strand-guiding member 36 defining a rounded corner between the upper curved surface and the aperture 361.

Figure 5:
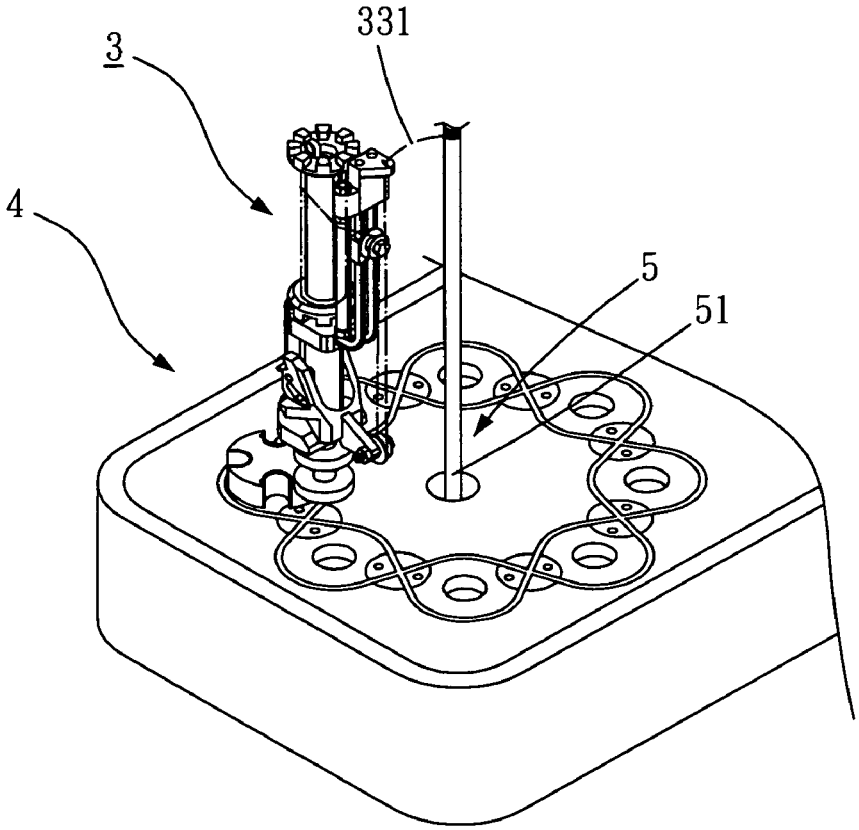
FIG. 5 shows the first preferred embodiment of present invention use on the a coaxial cable braiding apparatus.
Figure 6:
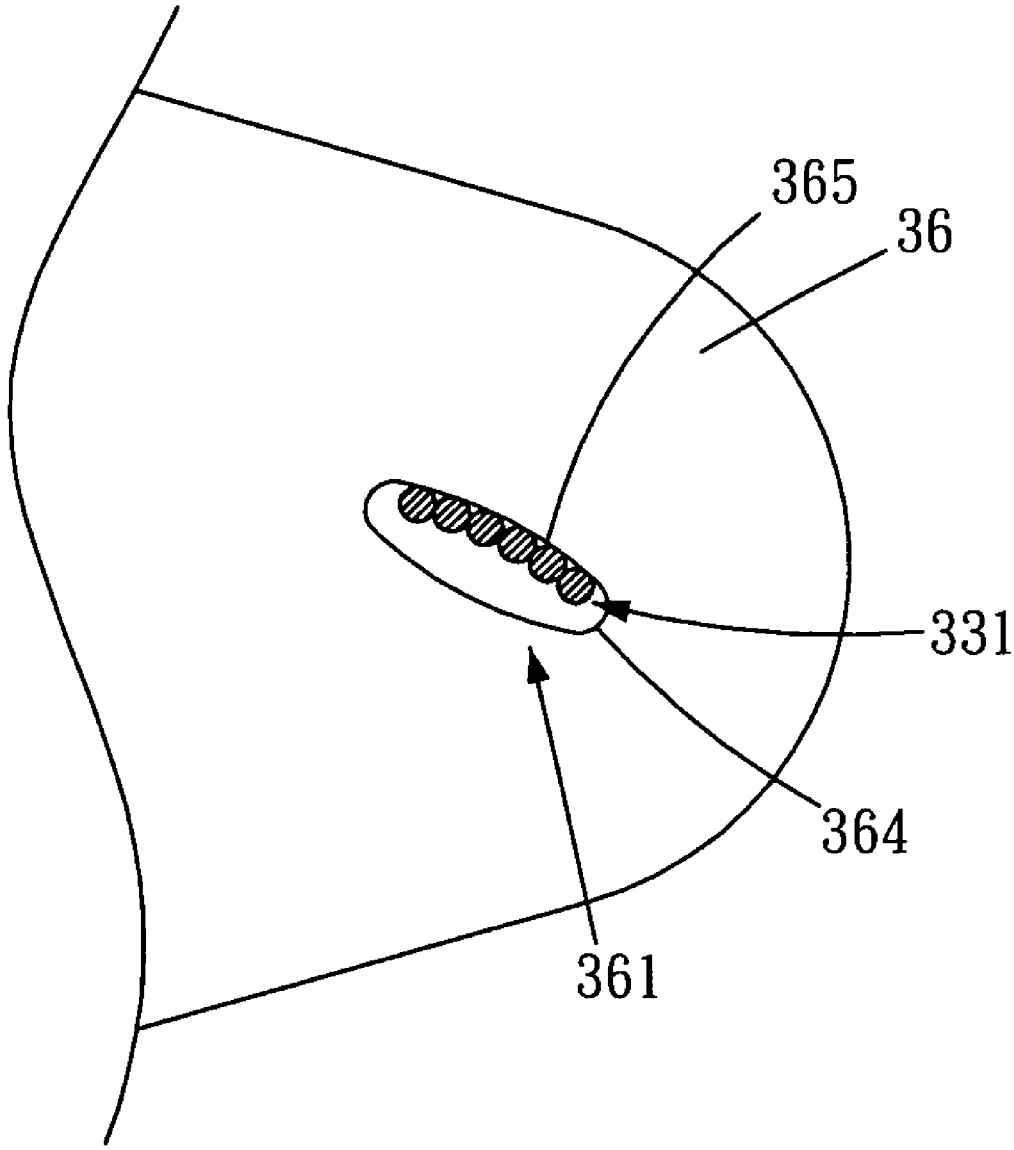
FIG. 6 is an enlarge end view of the strand-guiding member of the first preferred embodiment of the present invention with strands passing over.

Refer to FIG. 5, in use, said strand feeding device 3 travels the undulating path around the wire 51 on the braiding apparatus 5. Meanwhile, a strand 39 from the bobbin 33 trained on the upper 38 and lower strand-guiding reels 38, past through the aperture 361 and is subsequently fed into a braiding cone (not shown) of the braiding apparatus 4 for braiding into the wire of the coaxial cable 51 upon rotation of the bobbin 33 relative to the bobbin-mounting post 32. Refer to FIG. 6, the configuration of the aperture 361 having the first arc segments 365 with a minor curvature in which allows more strands 39 to appose thereon and prevent the strands 39 from overlapping. As the strands 39 pass through the aperture 361 without overlapping, each strand 39 bears the same pulling force which reduces the occurrence of breakage. Thus, after braiding the strands, there is no any interstice arisen between strands and strands. Consequently, this configuration of aperture 361 enhances the working fluency and produces a coaxial cable 5 with high quality of insulation and regular appearance.

Figure 7:
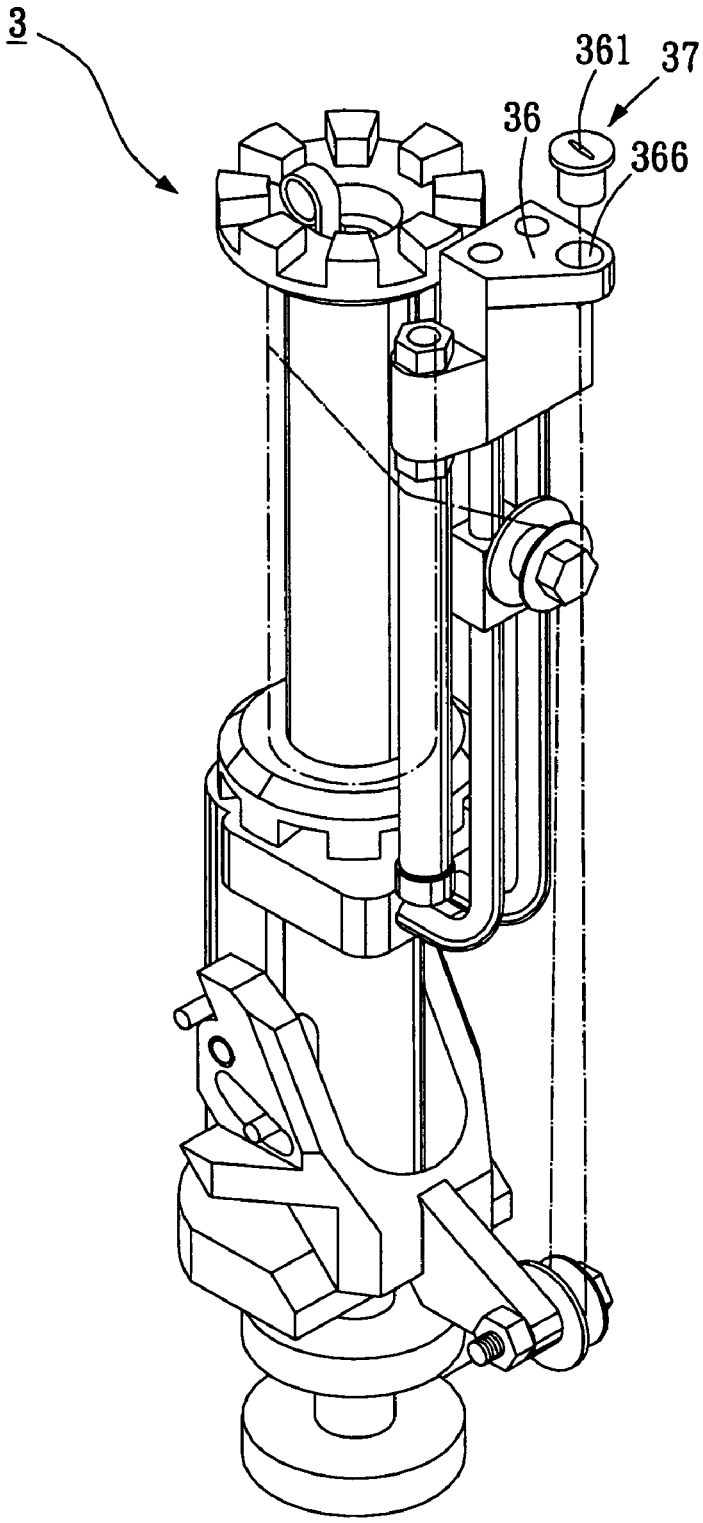
FIG. 7 is a perspective view to show another preferred embodiment of the present invention.

Refer to FIG. 7 shows the strand feeding device 3 of another preferred embodiment of present invention, wherein said strand-guiding member 36 having a circular bore 366 for containing a bushing 37. Said bushing 37 includes an aperture 361 having the all the feature of the aperture 361 in the first preferred embodiment for guiding strands.

In summary, the present invention discloses an elliptical aperture defined on the strand-guiding member that is able to prevent the strands from breakage during the operation and braid the cable with high insolating quality.

While we have shown and described the embodiment in accordance with the present invention, it should be clear to those skilled in the art that further embodiments may be made without departing from the scope of the present invention.

I claim:

1. A strand feeding device for a coaxial cable braiding apparatus, said strand feeding device comprising:

A seat body;

A bobbin-mounting post extending uprightly from said seat body in a longitudinal direction;

A bobbin is sleeved rotatably around said bobbin-mounting post;

A swinging arm is pivoted to the seat body and provides with a lower strand-guiding reel;

A pair of guiding posts extends upwardly from the seat body, and has an upper strand-guiding reel mounted adjustably thereon, and A strand-guiding member installed at the distal end of said guiding posts and includes aperture with first arc segment and second arc segments having greater curvature than the first arc segments, The first and second arc segments are capable of forming an aperture in which one end of said first arc segment is set to one end of said second arc segment and the other end of said first arc segment is set to the other end of said second arc segment, said aperture formed by the first arc segments having a major axis with respect to which the aperture is symmetrical, and the second arc segments having a minor axis with respect to which the aperture is symmetrical.

2. The strand feeding device as claimed in claim 1, wherein the strand-guiding member has a slightly curved upper surface.

3. The strand feeding device as claimed in claim 1, wherein the strand-guiding member has a rounded corner between the upper surface and the aperture.

* * * * *